United States Patent [19]

Zahn, III

[11] Patent Number: 4,526,473

[45] Date of Patent: Jul. 2, 1985

[54] HEADS UP SPORTS TIMER WITH ELECTRONIC TIME DISPLAY

[76] Inventor: Norman E. Zahn, III, 3180 N.W. 97th Way, Sunrise, Fla. 33321

[21] Appl. No.: 553,590

[22] Filed: Nov. 21, 1983

[51] Int. Cl.[3] ..... G04B 47/00

[52] U.S. Cl. ..... 368/10

[58] Field of Search ..... 368/10, 276–279, 368/89, 107–113; 350/36, 174

[56] References Cited

U.S. PATENT DOCUMENTS

| | | | |
|---|---|---|---|
| 3,475,902 | 11/1969 | Wessel | 58/126 |
| 3,636,700 | 1/1971 | Stemmler | 58/74 |
| 3,910,362 | 10/1975 | Piguet | 58/74 |
| 3,980,868 | 9/1976 | Thompson | 368/112 X |
| 3,998,045 | 12/1976 | Lester | 368/63 |
| 4,274,149 | 6/1981 | Flanagan | 368/10 |

*Primary Examiner*—Vit W. Miska

*Attorney, Agent, or Firm*—Oltman and Flynn

[57] ABSTRACT

A sports timer having an electronic time display is used by athletes in their training exercises for the purpose of helping them to improve their time performance in their sport.

15 Claims, 11 Drawing Figures

HEADS UP SPORTS TIMER WITH ELECTRONIC TIME DISPLAY

This invention relates generally to timing apparatus, and more specifically, to time apparatus used by athletes and carried upon their person, in their training exercises toward improved time performance in their field of sport.

Athletes in training in many fields of sport are, as is well known, very intent on reducing the elapsed time from the start to finish of certain sporting events, and in training, in the course of performing certain events, it is important for the athlete to be able to monitor his or her performance. It is, however, in many types of sport, often difficult for an athlete to look at a wristwatch or hand held timepiece while performing. A typical example is a swimmer in training, who for obvious reasons, cannot maintain a swimming stroke in order to look at a watch. Another example is a skier who must work with both hands in the performance of a strenuous training exercise.

Inventors have in the past aimed at devising time indicators to aid athletes in sporting events to monitor their elapsed time. U.S. Pat. No. 3,910,362 by A. Piguet issued Oct. 7, 1975 describes a timer with a dial with special color indicators to show time remaining in the course of performing certain events. U.S. Pat. No. 3,636,700 by E. Stemmler issued Jan. 25, 1971 describes a watch with a stopwatch hand that can be set to move at a certain preselected speed so that an athlete, at a glance, can quickly monitor his progress in the training exercise compared with the progress of the stopwatch hand.

U.S. Pat. No. 3,475,902 by P. Wessel issued Nov. 4, 1969 describes a diver's watch with a built-in indicator showing the diver's swimming depth and an adjustable bezel that can be set to indicate and warn if he exceeds a certain preset time limit under water.

The present invention provides a small timing device that can be worn by an athlete and started at the start of a sporting event and is mounted in relation to the athlete's eyes in a heads up mode, such that he can continuously or at a quick glance monitor his time related performance simply by turning his eyes toward the small timing device without interrupting his exercise.

The preferred embodiment of the invention is combined with a pair of goggles, or other eye protectors, used to support the timer in a suitable position, and the headband holding the goggles in place on the athlete's head is used to also hold a small watertight apparatus package with a battery for powering the timer's electronic components.

In another embodiment the timer may additionally have a time display that is especially suited to show quickly at a glance how the athlete is performing in relation to the time available for completion of the sporting event. Such a timer may, for example, be preset to indicate at the start the number of time units available for the completion of the event. Then, at the moment of the start the timer counts backward such that, when a count of zero is reached, the sporting event if successful should be completed. In other configurations especially suited for swimmers, the starting moment is detected automatically by means of a small water detecting cell combined with the timer, or the starting moment may be detected by means of a water pressure activated switch engaged by the pressure of movement through the water.

It is a primary object of the invention to provide a sports timer especially suited for an athlete performing an event, so that he or she, without interruption of athletic form, can see at a glance by turning the eye how he or she is performing in relation to the elapsed time.

It is another object to provide a sports timer that can be combined with a pair of goggles and attached to the goggles in such a position in relation to the athlete's eyes that the time displayed on the timer can be seen at a glance.

It is another primary object of the invention to provide a sports timer that displays the elapsed time from the start of a sports event in such a way that an athlete wearing the timer can quickly at a glance assess his time performance in relation to a preset time performance objective.

It is still another object of the invention to provide a sports timer that displays elapsed time in characters that can be seen in low ambient illumination.

It is still another object of the invention to provide a sports timer that is waterproof.

It is still another object of the invention to provide a sports timer that is capable of being started automatically without the help of the athlete.

It is still another object to provide a sports timer that is small in physical size and of light weight so that it can be installed close to the eyes of an athlete without being cumbersome or impeding to his or her athletic performance.

It is another object to provide a sports timer that is minimally restrictive of the athlete's binocular vision.

It is still another object of the invention to provide a sports timer that is dependable in operation and can be fabricated from materials and components that are readily available and can be produced by mass production methods at a reasonable cost.

Other objects and advantages of the invention will become clear in the course of the following detailed description with appended drawings and claims.

DETAILED DESCRIPTION

The following detailed description of the sports timer with appended drawings and claims covers some of the preferred embodiments of the invention. It is to be understood, however, that the invention is capable of other embodiments that are obvious to those skilled in the art to which it pertains.

The terminology used is for description and not for limitation. Wherever gender is used, the male gender is used to represent both genders.

The invention is described in the spatial orientation in which it would normally be worn by an upright standing person.

Figure 1:
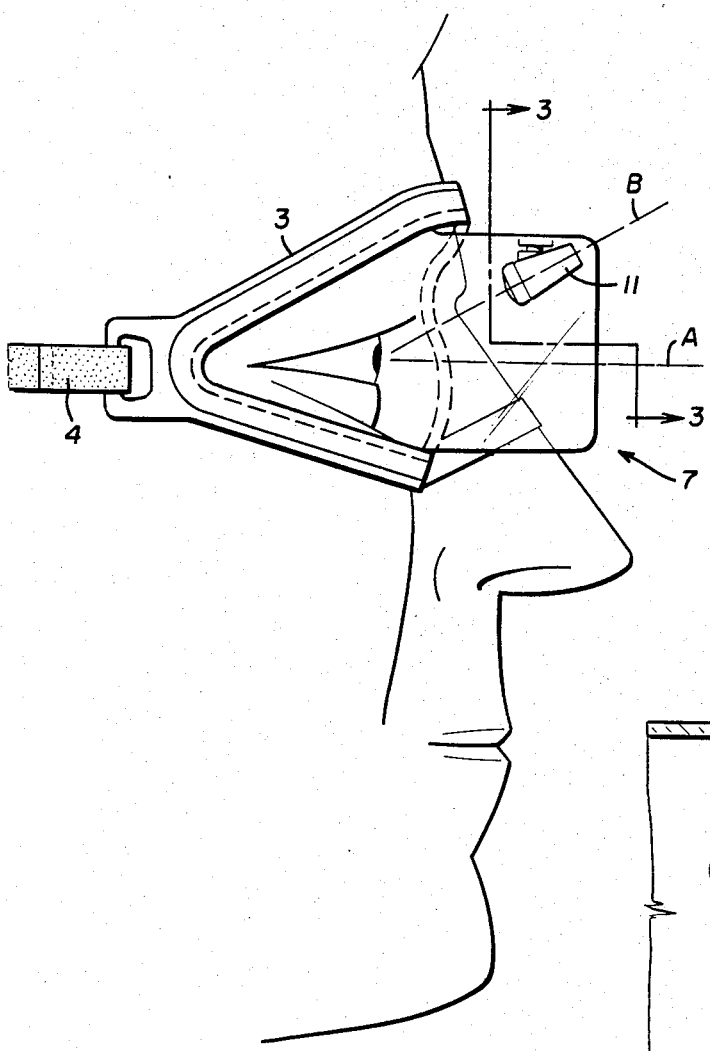
FIG. 1 is a vertical side view of an athlete's head wearing a sports timer combined with a pair of goggles accordin to the invention.

FIG. 1 shows the side of an athlete's head wearing the sports timer combined with a pair of protective goggles as they are often used by athletes. A pair of goggles as they are often used by swimmers consists of two individual goggles, one for each eye, mutually attached by means of an adjustable nose strap, which is best seen in the top-down view FIG. 9 which shows a right side goggle 2 and a left side goggle 2*a*.

The eyepiece 11 of the sports timer is seen installed in the right side goggle 2. It follows that the eyepiece could as well be installed in the left side goggle, and that two eyepieces with one in each goggle could as well be used. The invention is described with the eyepiece installed in the upper part of a right hand goggle and close to the eye of an athlete as best seen in FIG. 1.

The eyepiece is installed such that it minimally obstructs the eye's normal forward view as indicated by the broken line A and yet such that by turning his eye upward in the direction shown by the broken line B, he can look into the eyepiece 11 and see the character display showing the time.

Each goggle consists of a frame section 3 and 3*a* for the right and left sides respectively, each with a molded window piece, 2 and 2*a* for the right and left sides respectively. The window pieces are made of a strong, transparent section of plastic, preferably with a planar protruding front window, 5 and 5*a*, and suitably curved sides attached to the frame consisting of frame sections 3 and 3*a*.

Figure 9:
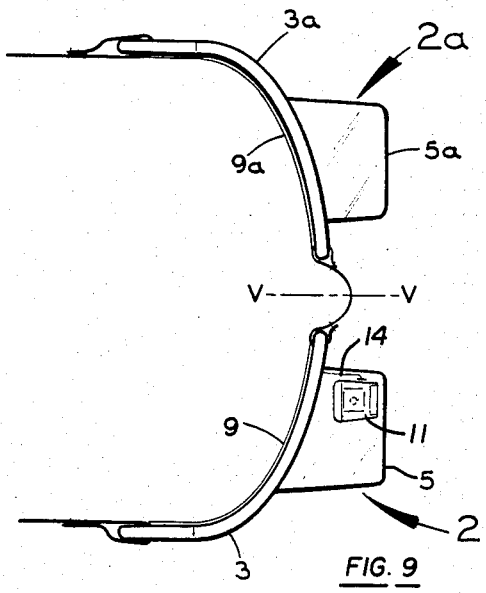
FIG. 9 is a top-down view of a pair of goggles with the eyepiece of the sports timer installed inside the right hand goggle.

Since the goggles are mirror image symmetrical about the vertical plane designated by the broken line v—v of FIG. 9, the following description will address generally the sports timer and its parts installed with the right hand goggle, and the reference numerals for the same parts of the left hand side will use the same numerals but will be suffixed with a letter "a" wherever indicated.

Figure 7:
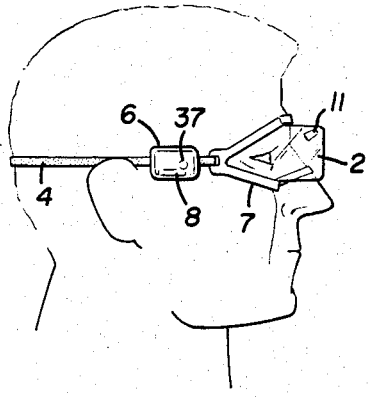
FIG. 7 is a vertical side view of an athlete's head wearing the sports timer with goggles and apparatus case.

A soft rubber or foam type lining 9, 9*a* is attached to the inside of the frame 3 so that the goggles rest lightly and watertight against the skin of the face. A head band 4 that may be elastic and/or equipped with an adjusting buckle holds the goggles against the face and also serves to support a small watertight apparatus case 6 as shown in FIG. 7.

Figure 2:
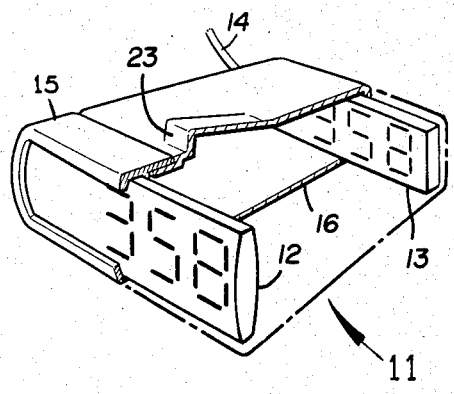
FIG. 2 is a perspective view of the sports timer's eyepiece with part of the outer wall broken away showing part of the objective lens and part of the time display.
Figure 3:
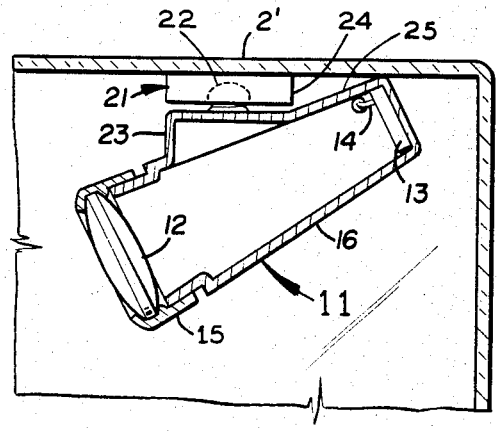
FIG. 3 is a cross-sectioned vertical view of the internal construction of the sports timer's eyepiece attached to a section of the transparent wall of the goggles.

The general construction of the eyepiece 11 is seen in FIG. 2 which is a perspective view of the eyepiece and FIG. 3 which is an enlarged cross-sectional vertical view which shows the construction in greater detail.

In FIG. 2 the eyepiece consists of an enclosure 16, containing an objective lens 12 at the front end and a time display 13 at the rear with parts of the numerals showing. The objective lens is made of a transparent refractive material such as glass or plastic, and has a convex curvature such that the small characters of the time display are seen magnified and clearly focused when placed close to the eye, as shown.

Figure 8A:
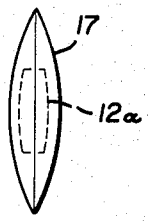
FIGS. 8*a* and 8*b* are a detail view of a convex lens cut so as to form the objective lens of the eyepiece.
Figure 8B:
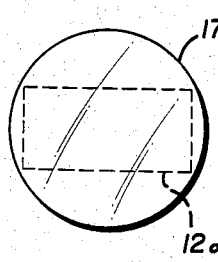

Tests and analysis have shown that the best results are obtained with a convex lens having a rectangular horizontally elongated shape as best seen in FIG. 8*a* and 8*b*, which shows a regular circular convex lens from the side in FIG. 8*a* and from the front in FIG. 8*b* and with the rectangular objective lens 12 in FIG. 3 formed by cutting out the lens section indicated by the dashed line 12*a* in FIGS. 8*a* and 8*b*. The lens 12 is inserted in a telescoping eye frame 15 (FIGS. 2 and 3) which allows improved focusing of the image of the numerals.

The lens is shown as a single section convex lens, and tests have shown that good results can be obtained with such a single section lens. It is, however, well known to those skilled in the optical sciences that a clearer or sharper image may be created by lenses composed of several matched lens sections, and this could also be applied to the present invention if merited.

The time display 13 consists of an assembly of characters which are preferably numerals, but alpha or other characters could also be included in case certain conditions not best represented by numerals should be more suitable.

There are several types of electronic character displays that are well known, and may be used such as the so-called liquid crystal displays (LCD) or the light emitting diode displays (LED). The LCD type displays have been found very suitable for the present application since these can be made very small and use very little battery power. In a typical embodiment, the time display consists of four (4) numerals disposed from left to right with the two most left hand numerals representing minutes and the two most right hand numerals representing seconds, as is well known from digital time displays. Additional numerals, representing tenths and hundredths of seconds, could also be included in the display.

Figure 6:
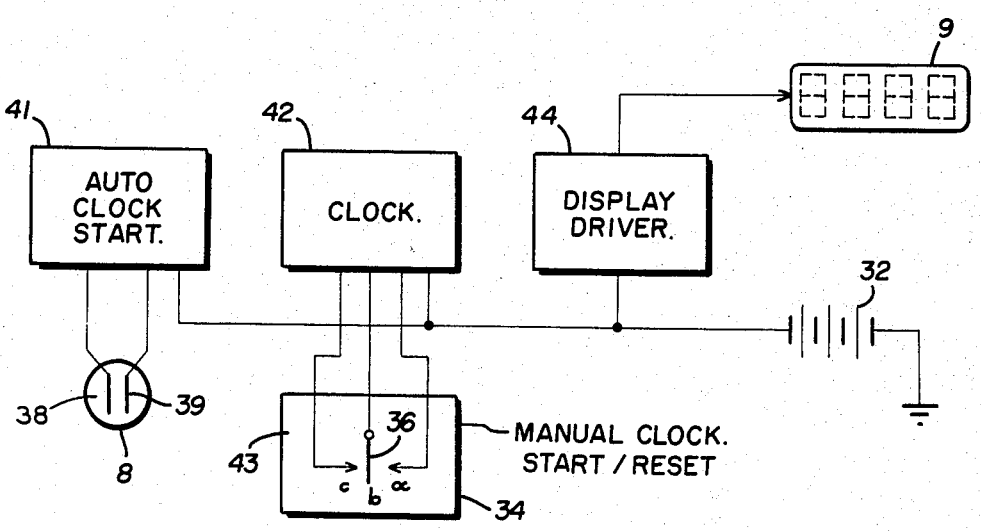
FIG. 6 is a block diagram of the sports timer showing the major functional blocks and their inter-connections.

The numeric characters are typically formed by means of seven (7) linear LCD elements of which the numeral "8" uses all seven elements as shown in FIG. 6. Each of the LCD elements is an elongated display element and any group of elements representing any of the ten numerals 0 through 9 may be generated by energizing a wire connected to each of the elements representing that numeral, and a return wire common to all the elements. In the present state of the art it is more economical to energize the elements from a so-called display driver which is typically a small diode matrix which is physically combined with display elements on a single integrated circuit, which usually contains four numerals, on a single small integrated circuit. Such LCD number displays are widely used in electronic watches and clocks and are manufactured by many different manufacturers.

The diode matrix in the display driver serves to reduce the number of electrical wires that have to be connected to the display, by the use of suitable encoding of the numbers. In a typical encoding scheme which uses the binary code, four wires are connected to each numerical character and all characters are connected to a common return wire. It follows that a typical four digit display with binary encoding will require four times four plus one wire which equals seventeen (17) wires. There are other methods which serve to further reduce the number of wires required called time multiplexing. In time multiplexing the individual characters are switched on and off in rapid sequence so fast that the eye does not detect the switching but perceives all characters as being on all the time simultaneously. With such multiplexing the number of wires required can be further reduced from seventeen (17) to eight (8). These techniques are widely used in the art of electronic character displays such as seen in watches and small calculators.

The wires driving the display are combined in a single lead 14 seen in FIGS. 2 and 3.

The eyepiece 11 as seen in FIG. 3 is attached to the underside of the generally horizontal upper wall 2' of the goggle's window piece by means of a small pivotable assembly of attachment parts generally, at 21 in FIG. 3. The pivotable attachment allows the eyepiece to be adjusted to best suit the individual preference of each user. The pivotable assembly consists of an upper washer 24 attached by suitable means such as an adhesive bonding to the underside of the upper goggle window wall 2'. The washer 24 has a central spherical hole which contains a matching spherical projection 22 attached to a small mounting plate 23, which is in turn attached by suitable means such as bonding or the like to the upper surface 25 of the eyepiece 11. It follows that the pivotable assembly of attachment may be constructed in other ways, or may be replaced by a fixed method of attachment if such should be merited.

The eyepiece includes provision for adjustment of the lens focal length by means of a telescoping lensholder 15, best seen on FIG. 3.

In still another method of construction the eyepiece enclosure 16 instead of being a unitary assembly may be constructed as integral with the material of the goggle window 25.

Figure 4:
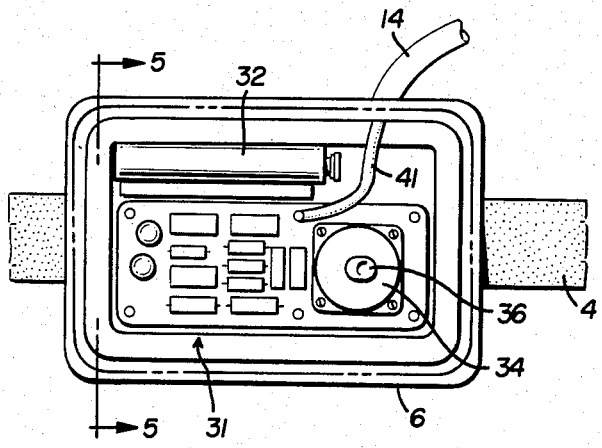
FIG. 4 is a vertical view of the electronic components mounted inside an apparatus case of the sports timer and with the case cover removed.

The apparatus case 6 is seen attached to the headband 4 in FIG. 7 and is seen in greater detail in FIG. 4 with the cover removed to show the internal components, which in a typical method of construction consist of a small so-called printed circuit board assembly generally at 31 containing the usual electronic components such as resistors, capacitors, diodes and integrated circuits. The lead 14 consisting of the wires from the time display 13 is attached to the circuit board assembly 31. The apparatus case also contains an electric battery 32 and connects to the printed circuit board assembly by means of a printed circuit board battery connector and lead 33.

Figure 5:
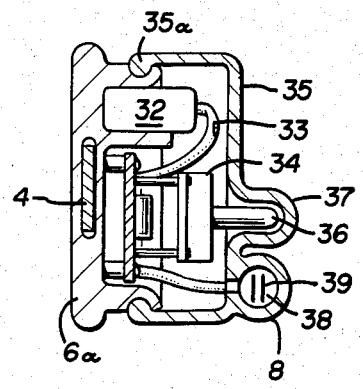
FIG. 5 is a transverse cross-sectional vertical view of the apparatus case showing the major internal components seen along the line 5—5 of FIG. 4.

A small toggle switch 34 is installed at the end of the circuit board with its toggle 36 projecting horizontally outward from the board as best seen in FIG. 5, wherein the apparatus case is seen in a vertical cross-sectional view through the case along the line 5—5 of FIG. 4. In this view, the apparatus case is shown with its cover 35 attached to the apparatus case base **6*a* along the perimeter 35*a* in a watertight connection. The toggle 36 projects into a boot 37 formed as an elastic, flexible "bubble" extending outward from the case cover. The toggle can be operated manually through the flexible bubble 37. The toggle switch 34** is a three position switch with an optional right hand locking position "a" in which all power to the circuits may be disconnected if merited, and a center, locking position "b" in which power is connected and the timer is standing still but ready to be started, and a left hand non-locking position "c" into which the toggle is thrown momentarily to reset and start the timer, and from which it returns automatically under spring pressure to the center position "b" in which position the timer is running, and the time display is counting at its normal speed.

In many types of sports, however, it is inconvenient and awkward for an athlete to have to manually start the timer and the sports timer is therefore equipped with means for automatic start of the timer.

In an embodiment especially suited for swimmers as shown, the automatic start is provided by means of a water detector 8 which detects presence of water in a small cavity 38 formed as an elongated tubular chamber that is integral with the apparatus case cover 35, and is open to the outside environs. The water detector 8 contains two elongated electrodes 39 with a narrow space between them. Since water in swimming pools and lakes is normally electrically conductive, a resistance measuring circuit which is part of the automatic timer start circuit 41 in FIG. 6 provides a start signal when the athlete dives into water.

In another automatic start version for swimmers, water pressure acting on a pressure sensor, included with the apparatus case, is used.

The automatic water start may be replaced by other methods of automatic start as merited for other types of sports. As examples, many sports events are started with a gun shot from a starter pistol. In such cases, the start mechanism may be a small microphone built into the timer apparatus case. Another type of automatic start is based on the use of a light sensitive photo diode built into the apparatus case, such that when the athlete passes through a light beam at the start gate the timer is automatically started. Still other methods of automatic start can be devised, based on other principles of radiation of a suitable start signal.

FIG. 6 is a functional block diagram of the sports timer. Here 9 is the timer display showing four digits, each with seven elements for each digit. The display driver 44 contains the encoding diode matrix which directly controls the individual display elements of each digit. A clock circuit 42 contains the electronic circuit which produces the time function, which is well known from electronic watches and clocks with a timer function. The clock circuit 42 is controlled by the manual start/reset switch 34, described above where the toggle 36 has the three positions "a" for off, "b" for ready or running and "c" for start. An automatic timer start circuit 41 is controlled by the water detector 8 with the electrodes 39 which detect presence of water in the water detector cavity 38. A battery 32 provides power to operate the timer.

OTHER EMBODIMENTS

In the preferred embodiment described above, the sports timer has been combined with a pair of protective goggles which serves also as a means for supporting the timer components. The timer, however, can also be attached directly to an athlete's head by means of a head band alone and suitable means for attaching the eyepiece alone.

Figure 10:
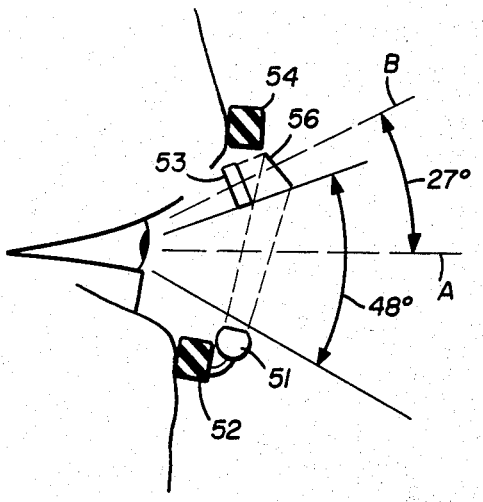
FIG. 10 is an embodiment of the sports timer which includes a small mirror between the objective lens and the time display.

In another embodiment, in a different construction of the eyepiece, a small mirror is included in the optical path, as shown in FIG. 10. Here, a human eye can look forward in the direction A or upward in the direction B as indicated by the broken lines A and B. A small timer display 51 is placed below the eye resting against the cheek with a small pad 52, and the timer display is seen through a small objective lens 53 as a mirror image of the display in the small mirror 56. In this case the numbers in the timer display are inverted due to the reflection of the image. The mirror and objective lens assembly is resting against the athlete's forehead by means of a small pad 54. It follows that with the inclusion of one or more mirrors in the optical path of the eyepiece, a greater freedom is afforded in the physical arrangement of the elements of the eyepiece in relation to the eye. One of the mirrors in such an arrangement may be of the "beam-splitting" or half-silvered type, which admits part of the timer display and still affords forward vision with the timer display superimposed on the forward field-of-view. With the elements of the eyepiece arranged as shown in FIG. 10, a wide vertical viewing angle is obtainable, while the timer display can be seen by turning the view upward from the horizontal line of view, which as shown by tests afford the athlete both a convenient field of vision and a convenient viewing angle to the timer display.

In still another embodiment of the invention the sports timer may be arranged with an additional mode of operation such that, at the time of start of the event, the timer is started at some preset and selectable time and then counts backward from the selected time till it reaches zero time. As an example, in this mode, when the toggle switch 34 is set from position a (off) to b, the timer display shows the preset time, e.g. 0125, indicating one minute and 25 seconds. At the moment of start, when the switch is momentarily set to position c, the timer runs backward, one second at a time to 0124, 0123 and so forth until it reaches 0000, and stops. By this means, an athlete may pace himself against the timer. The presetting of the selected time is done by means of programming switches. Such programming switches known as DIP-switches are widely used for programming of electronic circuits by setting a number of small toggles on the DIP-switches in accordance with a selected number code, such as binary or the like.

In still another embodiment, employing very small electronic components and a very compact packaging method the sports timer's electronic components are all included in the eyepiece, so that no separate apparatus case is required.

I claim:

1. Sports timer with electronic timing function comprising:

at least one eyepiece comprising a time display, electronic timer apparatus, means for starting and clearing said electronic timer apparatus, means for attachment of said sports timer to the head of an athlete such that said time display is visible to said athlete by turning his direction of view, said electronic timer apparatus operatively engaging said time display to show the number of time units counted from the moment of starting said timer circuit, means for supplying electric power to said electronic timer apparatus and said time display, said eyepiece further comprising an objective lens, said objective lens disposed generally in the line of sight between said athlete's eye and said time display.

2. Sports timer with electronic timing function as recited in claim 1 wherein said time display further comprises at least one numeric character, said numeric character representing units of time.

3. Sports timer with electronic timing function as recited in claim 1 wherein said eyepiece further comprises at least one mirror, said mirror disposed in the line of sight extended generally from said athlete's eye through the center of said objective lens and oriented such that said time display can be viewed through said objective lens and said mirror.

4. Sports timer with electronic timing function as recited in claim 1 wherein said electronic timer apparatus further comprises:

a clock circuit, a display driver, an automatic timer start circuit, an electric battery, said display driver operatively engaging said time display and operatively responsive to said clock circuit, said clock circuit operatively responsive to said means for starting and clearing said electronic timer apparatus.

5. Sports timer with electronic timing function as recited in claim 4 wherein said means for starting and clearing said electronic timer apparatus further comprises a manually operated swtich, said switch operatively engaging said clock circuit to start and clear said electronic timer apparatus.

6. Sports timer with electronic timing function as recited in claim 5 wherein said manually operated switch is a multiple function switch.

7. Sports timer with electronic timing function as recited in claim 1, wherein said means for starting and clearing said electronic timer apparatus further comprises:

an automatic timer start circuit, and an event start detector, said event start detector operatively engaging said automatic timer start circuit to start counting time units.

8. Sports timer with electronic timing function as recited in claim 7 wherein said event start detector is a water detector.

9. Sports timer with electronic timing function as recited in claim 1 wherein said means for attachment of said sports timer to the head of an athlete is a pair of protective goggles.

10. Sports timer with electronic timing function as recited in claim 1 wherein said means for attachment of said sports timer to the head of an athlete is an adjustable headband.

11. Sports timer with electronic timing function as recited in claim 1 further comprising:

a manually operated programming switch, said programming switch operatively engaging said electronic timer apparatus to count time units backward from a preselected number of time units, said preselected number of time units manually set into said programming switch.

12. Sports timer with electronic timing function as recited in claim 8 further comprising a watertight apparatus case.

13. Sports timer with electronic timing function as recited in claim 1 further comprising means for adjusting the distance between said objective lens and said time display.

14. Sports timer with electronic timing function as recited in claim 13 wherein said means for adjusting said distance between said objective lens and said time display is a telescoping section.

15. Sports timer with electronic timing function as recited in claim 13 wherein said eyepiece is pivotable.

* * * * *